US007781135B2

(12) United States Patent
Asarese et al.

(10) Patent No.: US 7,781,135 B2
(45) Date of Patent: Aug. 24, 2010

(54) EMULSION AGGREGATION TONER HAVING ZINC SALICYLIC ACID CHARGE CONTROL AGENT

(75) Inventors: Daniel W Asarese, Honeoye Falls, NY (US); Sarah Paulson, Rochester, NY (US); Maura A Sweeney, Irondequoit, NY (US); Grazyna E Kmiecik-Lawrynowicz, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 383 days.

(21) Appl. No.: 11/941,503

(22) Filed: Nov. 16, 2007

(65) Prior Publication Data

US 2009/0136863 A1 May 28, 2009

(51) Int. Cl.
*G03G 9/097* (2006.01)

(52) U.S. Cl. ..... 430/108.1; 430/45.4

(58) Field of Classification Search ..... 430/108.1
See application file for complete search history.

(56) References Cited

U.S. PATENT DOCUMENTS 4,206,064 A * 6/1980 Kiuchi et al. ..... 430/108.3
4,656,112 A * 4/1987 Kawagishi et al. ..... 430/108.8
5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,462,828 A 10/1995 Moffat et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,869,215 A 2/1999 Ong et al.
6,120,967 A 9/2000 Hopper et al.
6,489,371 B2 12/2002 Chao et al.
6,803,166 B2 10/2004 Cheng et al.
6,808,851 B2 10/2004 Bartel et al.
6,824,942 B2 11/2004 Silence et al.
6,828,073 B2 12/2004 Matsumura et al.
6,830,860 B2 12/2004 Sacripante et al.
6,841,329 B2 1/2005 Nguyen et al.
6,850,725 B2 2/2005 Silence et al.
6,890,696 B2 5/2005 Farrugia et al.
6,899,987 B2 5/2005 Vanbesien et al.
6,916,586 B2 7/2005 Ishiyama et al.
6,933,092 B2 8/2005 Yoshida et al.
6,936,396 B2 8/2005 Patel
6,942,954 B2 9/2005 Patel et al.
6,984,480 B2 1/2006 Vanbesien et al.
7,001,702 B2 2/2006 Cheng et al.
7,029,817 B2 4/2006 Robinson et al.
7,037,633 B2 5/2006 Hopper et al.
7,041,420 B2 5/2006 Vandewinckel et al.
7,041,425 B2 5/2006 Hopper et al.
7,049,042 B2 5/2006 Hopper et al.
7,052,818 B2 5/2006 Marcello et al.
7,097,954 B2 8/2006 Hawkins et al.
7,157,200 B2 1/2007 McStravick et al.
7,160,661 B2 1/2007 Moffat et al.
7,166,402 B2 1/2007 Veregin et al.
7,179,575 B2 2/2007 Moffat et al.
7,186,494 B2 3/2007 Ahuja et al.
7,208,253 B2 4/2007 Mayer et al.
7,217,484 B2 5/2007 Marcello et al.
2006/0078815 A1 * 4/2006 Ito et al. ..... 430/109.4

* cited by examiner

*Primary Examiner*—John L Goodrow
(74) *Attorney, Agent, or Firm*—Carter, DeLuca, Farrell & Schmidt, LLP

(57) ABSTRACT

A toner for developing electrostatic images including emulsion aggregation toner particles with a styrene acrylate latex resin, at least one additive, at least one colorant, and a charge control agent comprising 3,5 di-tert-butylsalicyclic acid zinc salt.

19 Claims, No Drawings

EMULSION AGGREGATION TONER HAVING ZINC SALICYLIC ACID CHARGE CONTROL AGENT

BACKGROUND

Described herein are toners for use in forming and developing high gloss images in electrostatographic, including xerographic, apparatuses. In embodiments, the toner is produced using emulsion aggregation processes. In embodiments, the toner exhibits improvement in toner tribo, charging, life performance, and print performance.

Emulsion aggregation toners can be used in electrophotography, including printing, copying, scanning, faxing, and the like, and including digital, image-on-image, and the like. The toner particles herein, in embodiments, can be made to have relatively uniform sizes, are nearly spherical in shape, and are environmentally friendly. U.S. patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, 5,869,215, 6,803,166, 6,808,851, 6,824,942, 6,828,073, 6,830,860, 6,841,329, 6,849,371, 6,850,725, 6,890,696, 6,899,987, 6,916,586, 6,933,092, 6,936,396, 6,942,954, 6,984,480, 7,001,702, 7,029,817, 7,037,633, 7,041,420, 7,041,425, 7,049,042, 7,052,818, 7,097,954, 7,157,200, 7,160,661, 7,166,402, 7,179,575, 7,186,494, 7,208,253, and 7,217,484, each incorporated herein by reference in its entirety.

One main type of emulsion aggregation toner includes emulsion aggregation toners that include styrene acrylate resin. See, for example, U.S. Pat. No. 6,120,967, incorporated herein by reference in its entirety, as one example.

Emulsion aggregation techniques typically involve the formation of an emulsion latex of the resin particles, which particles have a small size of, for example, from about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added to form aggregated toner particles. The aggregated toner particles are optionally heated to enable coalescence/fusing, thereby achieving aggregated, fused toner particles.

U.S. Pat. No. 5,462,828 describes a toner composition that includes a styrene/n-butyl acrylate copolymer resin having a number average molecular weight (Mn) of less than about 5,000, a weight average molecular weight of from about 10,000 to about 40,000, and a molecular weight distribution of greater than 6, that provides improved gloss and high fix properties at a low fusing temperature.

Traditionally, emulsion aggregation toners have not included charge control agents. This is an issue especially in high-volume machines that print more than six thousand copies per cartridge change. Problems with incorporation of charge control agents into emulsion aggregation toner include that traditional charge control agents have large particle sizes. Because of the large size, it has been difficult to incorporate the charge control additive into the toner particles during processing.

Therefore, it is desired to provide a charge control agent that has a smaller particle size and is easier to incorporate into the toner particles during emulsion aggregation processing. It is further desired to provide a toner having most or all of improved charging, tribo, gloss, print performance, and life performance.

SUMMARY

Disclosed in embodiments herein, is a toner for developing electrostatic images wherein the toner comprises emulsion aggregation toner particles comprising a styrene acrylate latex resin, at least one additive, at least one colorant, and a charge control agent comprising 3,5 di-tert-butylsalicyclic acid zinc salt.

Embodiments also include a toner for developing electrostatic images wherein the toner comprises emulsion aggregation toner particles comprising a styrene n-butyl acrylate copolymer, at least one additive, at least one colorant, and a charge control agent comprising 3,5 di-tert-butylsalicyclic acid zinc salt wherein the charge control additive has a particle size of from about 50 to about 500 nanometers.

Embodiments further include a set of toners for developing electrostatic images comprising a set of primary color toners comprising cyan toner, magenta toner, yellow toner, and black toner, wherein each of the cyan toner, magenta toner, yellow toner and black toner comprise emulsion aggregation toner particles comprising a styrene acrylate latex resin, at least one additive, at least one colorant, and a charge control agent comprising 3,5 di-tert-butylsalicyclic acid zinc salt.

DETAILED DESCRIPTION

In embodiments, the toners herein include emulsion aggregation toners including a charge control agent comprising 3,5 di-tert-butylsalicyclic acid zinc salt. In embodiments, the toners are useful in single component development systems that do not include a carrier. In other embodiments, the toners can be used with a carrier in a developer system with toner and carrier. In embodiments, the toners herein provide for one or all of improved tribo, gloss, charging, print performance and life performance.

Toner Resin

The toner particles described herein comprise a toner latex resin. In embodiments, the resin comprises a styrene acrylate polymer. Illustrative examples of specific styrene acrylate polymer resins for the binder include poly(styrene-alkyl acrylate), poly(styrene-alkyl methacrylate), poly(styrene-alkyl acrylate-acrylic acid), poly(styrene-alkyl methacrylate-acrylic acid), poly(styrene-alkyl acrylate-acrylonitrile-acrylic acid), poly(styrene-propyl acrylate), poly(styrene-butyl acrylate), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), poly(styrene-butylacrylate-betacarboxyethylacrylate), and other similar styrene acrylate. In embodiments, the resin comprises a styrene n-butyl acrylate copolymer.

In embodiments, the styrene acrylate copolymer latex resin as prepared into a toner particle has a glass transition temperature (Tg) of from about 50° C. to about 60° C., or from about 54° C. to about 57° C. The Tg can be measured using DSC. In addition, the weight average molecular weight (Mw) of the resin is from about 30 to about 100 kpse, or from about 55 to about 85 kpse, or from about 57 to about 80 kpse. In embodiments, the resin has a number average molecular weight (Mn) of from about 10 to about 30, or from about 12 to about 22 Kpse. The Mw and Mn can be measured using GPC. The latex resin comprises from about 30 to about 50 percent, or from about 41 to about 45 percent solids.

The monomers used in making the polymer latex resin are not limited, and may include any one or more of, for example, styrene, acrylates such as methacrylates, butylacrylates, β-carboxyethyl acrylate (β-CEA), ethylhexyl acrylate, octylacrylate, etc., butadiene, isoprene, acrylic acid, methacrylic acid, itaconic acid, acrylonitrile, etc., and the like. Known chain transfer agents can be used to control the molecular weight properties of the polymer. Examples of chain transfer agents include dodecanethiol, dodecylmercaptan, octanethiol, carbon tetrabromide, carbon tetrachloride, and the like, in various suitable amounts, for example of from about 0.1 to about 10 percent by weight of monomer, or about 0.2 to about 5 percent by weight of monomer. Also, crosslinking agents such as decanedioldiacrylate or divinylbenzene may be included in the monomer system in order to obtain higher molecular weight polymers, for example in an effective amount of about 0.01 percent by weight to about 25 percent by weight, or from about 0.25 to about 5 percent by weight.

In an embodiment, the monomer components, with any of the aforementioned optional additives, are formed into a latex emulsion and then polymerized to form small-sized polymer particles, for example on the order of from about 100 nm to about 400 nm, or about 150 nm to about 300 nm, or from about 170 to about 250 nm.

The monomers and any other emulsion polymerization components may be polymerized into a latex emulsion with or without the use of suitable surfactants. Any other suitable method for forming the latex polymer particles from the monomers may be used.

In an embodiment, the toner particles have a core-shell structure. In this embodiment, the core comprises toner particle materials discussed above, including at least a binder, colorant, and wax. Once the core particle is formed and aggregated to a desired size, as will be discussed further below, a thin outer shell is then formed upon the core particle. The shell may comprise binder material (i.e., free of colorant, release agent, etc.), although other components may be included therein if desired.

The shell can comprise a latex resin that is the same or different from that of the core particle. In embodiments, the core comprises a styrene acrylate resin and the shell comprises a styrene acrylate resin. In embodiments, both the core and the shell comprise a styrene n-butyl actylate copolymer. The core latex may be added in an amount of from about 50 to about 80 percent, or from about 60 to about 75 percent by weight of total solids. The shell latex may be added to the toner aggregates in an amount of about 20 to about 50 percent, or from about 25 to about 40 percent by weight of the total binder materials. By addition of the CCA to the toner, the amount of resin can be reduced. In embodiments without the CCA, the resin is usually present in amounts of 85 percent or more by weight of total solids.

In embodiments, the shell resin may have either the same, higher or a lower glass transition temperature (Tg) than the binder of the toner core particle. A higher Tg may be desired to limit penetration of the external additives and/or wax into the shell, while a lower Tg shell may be desired where greater penetration of the external additives and/or wax is desired. A higher Tg shell may also lend better shelf and storage stability to the toner. In embodiments, both the core and shell resins have a Tg of from about 50° C. to about 80° C., or from about 54° C. to about 75° C. as measured by DSC.

Colorants

Various known colorants, such as pigments, dyes, or mixtures thereof, can be present in the toner in an effective amount of, for example, from about 1 to about 10 percent by weight of toner, or from about 1 to about 6, or from about 1.25 to about 5 percent by weight, that can be selected include black, cyan, violet, magenta, orange, yellow, red, green, brown, blue or mixtures thereof.

Examples of a black pigment include carbon black, copper oxide, manganese dioxide, aniline black, activated carbon, non-magnetic ferrite and magnetite and the like, and wherein the magnetites, especially when present as the only colorant component, can be selected in an amount of up to about 70 weight percent of the toner. However, in embodiments, the toner is non-magnetic.

Specific examples of blue pigment include Prussian Blue, cobalt blue, Alkali Blue Lake, Victoria Blue Lake, Fast Sky Blue, Indanethrene Blue BC, Aniline Blue, Ultramarine Blue, Calco Oil Blue, Methylene Blue Chloride, Phthalocyanine Blue, Phthalocyanine Green and Malachite Green Oxalate or mixtures thereof. Specific illustrative examples of cyans that may be used as pigments include Pigment Blue 15:1, Pigment Blue 15:2, Pigment Blue 15:3 and Pigment Blue 15:4, copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like.

Examples of a green pigment include Pigment Green 36, Pigment Green 7, chromium oxide, chromium green, Pigment Green, Malachite Green Lake and Final Yellow Green G.

Examples of a red or magenta pigment include red iron oxide, cadmium red, red lead oxide, mercury sulfide, Watchyoung Red, Permanent Red 4R, Lithol Red, Naphthol Red, Brilliant Carmine 3B, Brilliant Carmine 6B, Du Pont Oil Red, Pyrazolone Red, Rhodamine B Lake, Lake Red C, Rose Bengal, Eoxine Red and Alizarin Lake. Specific examples of magentas that may be selected include, for example, Pigment Red 49:1, Pigment Red 81, Pigment Red 122, Pigment Red 185, Pigment Red 238, Pigment Red 269, Pigment Red 57:1, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like.

Examples of a violet pigment include manganese violet, Fast Violet B and Methyl Violet Lake, Pigment Violet 19, Pigment Violet 23, Pigment Violet 27 and mixtures thereof.

Specific examples of an orange pigment include Pigment Orange 34, Pigment Orange 5, Pigment Orange 13, Pigment Orange 16, and the like. Other orange pigments include red chrome yellow, molybdenum orange, Permanent Orange GTR, Pyrazolone Orange, Vulkan Orange, Benzidine Orange G, Indanethrene Brilliant Orange R and Indanethrene Brilliant Orange GK.

Specific examples of yellow pigments are Pigment Yellow 17, Pigment Yellow 74, Pigment Yellow 83, Pigment Yellow 93, Yellow 180, Yellow 185, and the like. Other illustrative examples of yellow pigment include chrome yellow, zinc yellow, yellow iron oxide, cadmium yellow, chrome yellow, Hansa Yellow, Hansa Yellow 10G, Hansa Brilliant Yellow, Hansa Brilliant Yellow 5GX03PY74, Benzidine Yellow G, Benzidine Yellow GR, Suren Yellow, Quinoline Yellow, Permanent Yellow NCG. diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

Examples of a white pigment include Pigment White 6, zinc white, titanium oxide, antimony white and zinc sulfide.

Examples of a brown pigment include burnt sienna, brown ochre, sepia, caput mortuum, burnt umber, basic brown 2, basic brown 17, Pigment brown 25, and the like, and mixtures thereof.

Colorants for use herein can include one or more pigments, one or more dyes, mixtures of pigment and dyes, mixtures of pigments, mixtures of dyes, and the like. The colorants are used solely or as a mixture.

Examples of a dye include various kinds of dyes, such as basic, acidic, dispersion and direct dyes, e.g., nigrosine, Methylene Blue, Rose Bengal, Quinoline Yellow and Ultramarine Blue.

A dispersion of colorant particles can be prepared by using a rotation shearing homogenizer, a media dispersing apparatus, such as a ball mill, a sand mill and an attritor, and a high pressure counter collision dispersing apparatus. The colorant can be dispersed in an aqueous system with a homogenizer by using a surfactant having polarity.

The colorant may be selected from the standpoint of hue angle, chroma saturation, brightness, weather resistance and dispensability in the toner. In the case where the colorant particles in the toner have a median diameter of from 100 to 330 nm and the coloration property can be assured. The median diameter of the colorant particles can be measured, for example, by a laser diffraction particle size measuring apparatus (MicroTrac UPA 150, produced by MicroTrac Inc.).

Wax

In addition to the latex polymer binder and the colorant, the toners may also contain a release agent, in embodiments, a wax dispersion. The release agent is added to the toner formulation in order to aid toner offset resistance, e.g., toner release from the fuser member, particularly in low oil or oil-less fuser designs. Specific examples of suitable release agents include a polyolefin, such as polyethylene, polypropylene and polybutene, a silicone exhibiting a softening point upon heating, an aliphatic amide, such as oleic acid amide, erucic acid amide, recinoleic acid amide and stearic acid amide, vegetable wax, such as carnauba wax, rice wax, candelilla wax, wood wax and jojoba oil, animal wax, such as bees wax, mineral or petroleum wax, such as montan wax, mountain wax, ozokerite, ceresin, paraffin wax, microcrystalline wax and Fischer-Tropsch wax, and modified products thereof. In embodiments, a polyethylene wax such as POLYWAX® 725 can be used. Mixtures of waxes can also be used.

The release agent may be dispersed in water along with an ionic surfactant or a polymer electrolyte, such as a polymer acid and a polymer base, and it is heated to a temperature higher than the melting point thereof and is simultaneously dispersed with a homogenizer or a pressure discharge disperser (Gaulin Homogenizer) capable of applying a large shearing force, so as to form a dispersion of particles having a median diameter of 1 μm or less.

The release agent can be added in an amount of from about 3 to about 15 percent by weight, or from about 5 to about 10 percent by weight, or about 6 percent to about 10 percent, based on the total weight of the solid content constituting the toner.

The particle diameter of the resulting release agent particle dispersion can be measured, for example, by a laser diffraction particle size measuring apparatus (Microtrac UPA 150 manufactured by MicroTrac Inc.). The release agent, in embodiments, has a particle size of less than about 1.0 micron. The resin fine particles, the colorant fine particles, and the release agent particles can be aggregated, and then the resin fine particle dispersion is added to attach the resin fine particles on the surface of the aggregated particles from the standpoint of assurance of charging property and durability.

Additives

The toner may also include additional known positive or negative charge additives in effective suitable amounts of from about 0.1 to about 5 weight percent of the toner, or from about 0.1 to about 3 percent of the toner, or from about 1 to about 1.75 weight percent of the toner. Examples include oxides of titania, silica, cerium, tin oxide, aluminum oxide, and the like. Commercially available examples include MT-3103 Titania, R805 silica, and the like. In embodiments, silica is applied to the toner surface for toner flow, tribo enhancement, improved development and transfer stability and higher toner blocking temperature. In embodiments, $TiO_2$ is applied for improved relative humidity (RH) stability, tribo control and improved development and transfer stability. The external surface additives can be used with or without a coating. In addition, more than one of the same type of additive can be added, for example, two different silicas and/or two different titanias, and the like.

In embodiments, silica can have a particle size of from about 5 to about 15 nm, or from about 8 to about 12 nm. The additives can be treated/coated with HMDS (hexamethyldisilazane) and/or a PDMS (polydimethylsiloxanes). The inorganic additive particles of this size range may exhibit a BET (Brunauer, Emmett and Teller) surface area of from about 100 to about 300 $m^2/g$, or from about 125 to about 250 $m^2/g$, although the values may be outside of this range as needed. Titania (titanium oxide) can have a size of from about 5 nm to about 130 nm, or from about 10 to about 30 nm. The titania particles can exhibit a BET surface area of from about 20 to about 120 $m^2/g$, or from about 30 to about 80 $m^2/g$, although the values may be outside of this range as needed. The additive package may further include a second silica having a size larger than the first silica and having a size of from about 20 nm to about 150 nm, and optionally can be treated and/or coated with HMDS and/or PDMS.

Charge Control Agent

A charge control agent is incorporated into the toner. In embodiments, the charge control agent is 3,5 di-tert-butylsalicyclic acid zinc salt. The charge control agent particle size can be adjusted, in embodiments, to a particle size of from about 50 to about 500, or from about 150 to about 300, or from about 175 to about 275 nm. It has been found that incorporating the charge control agent into emulsion aggregation toner was difficult. Not only was the particle size of the charge control agent critical, but the process for incorporating the charge control agent was also specific in order to avoid agglomeration and particle failure.

The 3,5-di-tert-butylsalicylic acid zinc salt can be incorporated into the core of the particle, the shell of the particle or a combination of both. If placing in the core and both, the CCA is added during homogenization but just before the addition of the PAC coagulating agent. The mixture is then homogenized according to procedure and then the batch is heated, aggregated and coalesced. If adding to the shell or to both the core and shell, the CCA should be added to the shell latex first before shell addition. The shell mixture is added via pump until complete. The process then proceeds similar to the control sample. The charge control agent is present in the toner in an amount of from about 0.1 to about 3, or from about 0.3 to 2 or from about 0.3 to 1 percent by weight of total solids.

The resulting emulsion aggregation toner including the charge control agent described herein provides a toner with improved charging. In embodiments, tribo is increased from about 20 to about 30 units. The crosslinking of the charge control agent and toner is decreased.

Incorporation of the zinc CCA into the toners compared to the control showed a 10-18 uC/g increase in tribo using the carrier blow off method. A simple PDMS silica was used as the toner additive and the toner formulation was not optimized for tribo. Results from life testing show improved density and reduced background over life.

Surfactants

One or more surfactants may be used in the emulsion aggregation process. Suitable surfactants may include anionic, cationic and nonionic surfactants.

Anionic surfactants include sodium dodecylsulfate (SDS), sodium dodecyl benzene sulfonate, sodium dodecyinaphthalene sulfate, dialkyl benzenealkyl, sulfates and sulfonates, and abitic acid. An example of suitable anionic surfactants is a branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, benzalkonium chlorides, and the like. An example of a cationic surfactant is benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy) ethanol. An example of a nonionic surfactant is alkyl phenol ethoxylate.

Emulsion Aggregation

Any suitable emulsion aggregation (EA) procedure may be used in forming the emulsion aggregation toner particles without restriction. These procedures typically include the basic process steps of at least aggregating a latex emulsion containing binder, one or more colorants, optionally one or more surfactants, optionally a wax emulsion, optionally a coagulant and one or more additional optional additives to form aggregates, optionally forming a shell on the aggregated core particles as discussed above, subsequently optionally coalescing or fusing the aggregates, and then recovering, optionally washing and optionally drying the obtained emulsion aggregation toner particles.

An example emulsion aggregation coalescing process includes forming a mixture of latex binder, colorant dispersion, optional wax emulsion, optional coagulant and deionized water in a vessel. In known methods, the mixture is then sheared using a homogenizer until homogenized and then transferred to a reactor where the homogenized mixture is heated to a temperature of, for example, at least about 50° C., or about 60° C. to about 70° C. and held at such temperature for a period of time to permit aggregation of toner particles to a desired size. However, in embodiments, the mixture is mixed at a temperature above the Tg of the resin, or from about 60 to about 70, or from about 62 to about 70° C., and held at such temperature for a period of time to permit aggregation of toner particles to a desired size. In this regard, aggregation refers to the melding together of the latex, pigment, wax and other particles to form larger size agglomerates. Once a desired core particle size is reached, additional latex binder may then be added to form a shell upon the aggregated core particles. In embodiments, the outer shell can be added until the appropriate particle size is reached, such as from about 5 to about 8, or from about 6 to about 8, or from about 7 to about 7.5 μm. Once the desired size of aggregated toner particles is achieved, aggregation is then halted, for example by adjusting the pH of the mixture in order to inhibit further toner aggregation, such as by adding ammonium hydroxide. The toner particles are then coalesced at a temperature of at least about 80° C., or from about 90° C. to about 100° C., and the pH adjusted in order to enable the particles to coalesce and spherodize (become more spherical and smooth). The desired and shape and morphology are obtained and they depend on the amount of wax protrusions desired on the surface of the particle and the shape of the particle. The mixture is then cooled to a desired temperature, at which point the aggregated and coalesced toner particles are recovered and optionally washed and dried.

The toner particles are blended with external additives following formation. Any suitable surface additives may be used.

In embodiments, the toner particles are made to have a volume mean diameter of from about 5 to about 8, or from about 6 to about 8, or from about 7 to about 7.5 μm. The toners herein can have an average circularity of about 0.950 to about 0.990, or from about 0.960 to about 0.980, or from about 0.96 to about 0.967. and a volume and number geometric standard deviation ($GSD_{v\ and\ n}$) of from about 1.10 to about 1.30, or from about 1.15 to about 1.25, or from about 1.18 to about 1.20. The average particle size refers to a volume average size that may be determined using any suitable device, for example a conventional Coulter counter. The circularity may be determined using any suitable method, for example the known Malvern Sysmex Flow Particle Integration Analysis method. The circularity is a measure of the particles closeness to perfectly spherical. A circularity of 1.0 identifies a particle having the shape of a perfect circular sphere. The GSD refers to the upper geometric standard deviation (GSD) by volume (coarse level) for (D84/D50) and can be from about 1.10 to about 1.30, or from about 1.15 to about 1.25, or from about 1.18 to about 1.20. The geometric standard deviation (GSD) by number (fines level) for (D50/D16) can be from about 1.10 to about 1.30, or from about 1.15 to about 1.25, or from about 1.23 to about 1.25. The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution.

The toners herein provide a shaper factor or circularity of from about 0.950 to about 0.990, or from about 0.960 to about 0.980, or from about 0.960 to about 0.967. In addition, the toners herein have an onset Tg of from about 50 to about 60, or from about 53 to about 58, or about 55° C.

The toners herein have an improved gloss of from about 10 to about 80 ggu, or from about 20 to about 60 ggu, or from about 25 to about 45 ggu. The toner tribo measured as a suck off from the developer roll is from about 15 to about 35 uC/gm, or from about 20 to about 30. Also, the tribo on carrier is from about 40 to about 90 uC/gm, or from about 50 to about 75.

The toner particles described herein can be used as single component developer (SCD) formulations that are free of carrier particles.

The aforementioned toner particles as a single component developer composition in SCD deliver a very high transfer efficiency.

Typically in SCD, the charge on the toner is what controls the development process. The donor roll materials are selected to generate a charge of the right polarity on the toner when the toner is brought in contact with the roll. The toner layer formed on the donor roll by electrostatic forces is passed through a charging zone, specifically in this application a charging roller, before entering the development zone. Light pressure in the development nip produces a toner layer of the desired thickness on the roll as it enters the development zone. This charging typically will be for only a few seconds, minimizing the charge on the toner. An additional bias is then applied to the toner, allowing for further development and movement of the controlled portion of toner to the photoreceptor. If the low charge toner is present in sufficient amounts, background and other defects become apparent on the image. The image is then transferred from the photoreceptor to an image receiving substrate, which transfer may be direct or indirect via an intermediate transfer member, and then the image is fused to the image receiving substrate, for example by application of heat and/or pressure, for example with a heated fuser roll.

The toner and developer will now be further described via the following examples.

The following Examples further define and describe embodiments herein. Unless otherwise indicated, all parts and percentages are by weight.

EXAMPLES

Example 1

Synthesis of Latex (Toner Resin)

A latex was prepared by semicontinuous emulsion polymerization of styrene/butyl acrylate/β-carboxyethylacrylate, 75/25/3 parts (by weight), and using a diphenyloxide disulfonate surfactant as follows.

An 8-liter jacketed glass reactor was fitted with two stainless steel 450 pitch semi-axial flow impellers, thermal couple temperature probe, water cooled condenser with nitrogen outlet, a nitrogen inlet, internal cooling capabilities, and a hot water circulating bath. After reaching a jacket temperature of 82° C.+/−1.00° C. and continuous nitrogen purge, the reactor was charged with 1779.98 grams of distilled water and 2.89 grams of Dowfax 2A1 (Tm). The stirrer was then set at 200 RPM and maintained at this speed for 2 hours. The reactor contents were controlled at 75° C.+/−0.40° C. by the internal cooling system. A monomer emulsion was prepared by combining 1458.7 grams of styrene, 486.2 grams of n-butyl acrylate, 58.4 grams of β-carboxyethylacrylate, and 9.7 grams of dodecylmercaptan, with an aqueous solution of 38.4 grams of DOWFAX® 2A1™, and 921.5 grams of distilled water. The mixture was then subjected to a series of on/off high shear mixing to form a stable emulsion.

From the prepared stable emulsion, about 59.5 grams was transferred into the reactor and stirred for approximately 10 minutes to maintain a stable emulsion, and to allow the reactor contents to equilibrate at 75° C. An initiator solution prepared from 38.9 grams of ammonium persulfate in 134.7 grams of distilled water was then added over a period 20 minutes by pump to the reactor contents. This was immediately followed by flushing the pump with about 9.5 grams of distilled water into the reactor. Stirring continued for an additional 20 minutes to allow seed particle formation. The remaining approximate 2913.5 grams of monomer emulsion were then fed continuously into the reactor over a period of about 193 minutes, followed immediately by an additional distilled water flush of about 45 grams. After monomer emulsion addition was completed, the reaction was allowed to post react for about 180 minutes at 75° C. At this time the reactor and contents was cooled to room temperature and the latex removed.

The resulting latex polymer possessed an Mw of about 51,500, a Mn of about 13,600, as determined by GPC, and an onset Tg of approximately 56.8° C. by DSC. The latex resin possessed a volume average diameter of 231 nanometers measured on a Microtrac light scattering instrument.

Example 2

Emulsion Aggregation Processing of Toner with CCA

A 2 liter reactor was charged with 600 grams DI water, 332 grams styrene/butylacrylate latex dispersion, 66 grams REGAL® 330 Carbon Black dispersion, 16 grams Pigment Blue 15:3 dispersion, 74 grams polyethylene wax dispersion and 6.7 grams 3,5 Di-tert-butylsalicylic acid zinc salt then titrated with 4.5 grams polyaluminum chloride aggregating agent. The mixture was homogenized for 26 minutes total at 4,000 rpm. After homogenization the homogenizer was removed and a 4-inch A200 impeller was set 1 inch from the bottom of the reactor and was set at 300 rpm. The reactor bath was set to 60° C. and aggregation started. Aggregation went 50 minutes until appropriate aggregate size was reached (5.71 um). Next, 200 grams latex was mixed with 3.15 gm 3,5 Di-tert-butylsalicylic acid zinc salt. This mixture was titrated in until gone (13 minutes). The mixture was kept mixing for 9 more minutes. Next, at a particle size of 7.52 um, sodium hydroxide base was added to pH 4.7 and impeller speed was reduced to 160 rpm. The mixture was held for 2 minutes then the temperature was ramped to 101° C. At 90° C. the pH was read at 3.9 and at 96° C. the bath was set at 100.5° C. and particle size and shape measurements read every half hour. After three hours the batch was cooled to 63° C. and the pH adjusted to 10. The final particle slurry was then washed and dried.

Table 1 demonstrates the control parent particle compared to the parent particle with 0.6% CCA incorporation. Note that the parent tribo on the emulsion aggregation carrier was demonstrated to be 16.5 μc/g higher than that of the control. This increase will significantly impact the toner performance in single component development systems, allowing for lower additive amounts that will lead to less issues with toner additive buildup (TAB), cleaning defects, and improved flow and background (higher charge overall, consistent charge over life). FIG. 1 depicts successfully incorporated CCA 3,5 Di-tert-butylsalicylic acid zinc salt.

The percent fines was measured at 1.26-3.17. The percent coarse volume was measured at 12.7-39.24.

TABLE 1

| Batch ID | Type of Sample | Vol. D50 (mm) | 84/50 vol. | 50/16 num. | Vol. diam. 32 | Shape (2100) 143 | Parent tribo |
|---|---|---|---|---|---|---|---|
| SJP-13K | Control | 7.16 | 1.195 | 1.215 | 7.06 | 0.966 | 46.42 |
| SJP-26K | 0.6% CCA | 6.97 | 1.184 | 1.221 | 6.83 | 0.964 | 62.92 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A toner for developing electrostatic images wherein said toner comprises emulsion aggregation toner particles comprising a styrene acrylate latex resin, at least one additive, at least one colorant, and a charge control agent comprising 3,5 di-tert-butylsalicyclic acid zinc salt having a particle size of from about 50 to about 500 nanometers, wherein said toner particles further comprise a shell layer thereon.

2. A toner as in claim 1, wherein said charge control agent has a particle size of from about 150 to about 250 nanometers.

3. A toner as in claim 2, wherein said charge control agent has a particle size of from about 175 to about 275 nanometers.

4. A toner as in claim 1, wherein said charge control agent is present in said toner in an amount of from about 0.1 to about 3 percent by weight of total solids.

5. A toner as in claim 4, wherein said charge control agent is present in said toner in an amount of from about 0.3 to about 2 percent by weight of total solids.

6. A toner as in claim 1, wherein said styrene acrylate latex resin is a styrene n-butyl acrylate copolymer.

7. A toner as in claim 1, wherein said latex resin is present in said toner in an amount of from about 50 to about 80 percent by weight of total solids.

8. A toner as in claim 1, wherein said charge control additive is present in both said toner and said shell.

9. A toner as in claim 1, wherein said shell layer consists essentially of a styrene acrylate polymer.

10. A toner as in claim 9, wherein said styrene acrylate latex resin is a styrene n-butyl acrylate copolymer.

11. A toner as in claim 1, wherein said at least one additive is selected from the group consisting of silica, titania, zinc stearate, alumina, and mixtures thereof.

12. A toner as in claim 1, further comprising a wax selected from the group consisting of polyethylene, polypropylene wax, paraffin wax, Montan wax, Fischer Tropsch wax, and mixtures thereof.

13. A toner as in claim 1, wherein the toner particles have circularity of from about 0.960 to about 0.980.

14. A toner as in claim 1, wherein said toner has a toner tribo of from about 15 to about 35 uC/gm.

15. A toner as in claim 1, wherein said toner has a tribo increase of from about 20 to about 30 units.

16. A toner as in claim 1, wherein said toner has a gloss of from about 10 to about 80 ggu.

17. A set of toners for developing electrostatic images comprising a set of primary color toners comprising cyan toner, a magenta toner, yellow toner, and black toner, wherein each of said cyan toner, magenta toner, yellow toner and black toner comprise emulsion aggregation toner particles comprising a styrene acrylate latex resin, at least one additive, at least one colorant, and a charge control agent comprising 3,5 di-tert-butylsalicyclic acid zinc salt having a particle size of from about 50 to about 500 nanometers, wherein said toner particles further comprise a shell layer thereon.

18. A set of toners as in claim 17, further comprising a set of secondary color toners comprising at least one of orange toner, red toner, green toner, brown toner, white toner, and blue toner.

19. The toner of claim 6, wherein the resin further comprises β-carboxyethylacrylate.

* * * * *